United States Patent [19]

Kennedy et al.

[11] Patent Number: 5,069,131

[45] Date of Patent: Dec. 3, 1991

[54] PRIMER

[75] Inventors: David Kennedy, Rosanna; Gerard Mussett, Elwood; Alfons Van Maanan, St. Kilda; James N. Smetham, Kalgoorlie, all of Australia

[73] Assignee: ICI Australia Operations Proprietary Limited, Australia

[21] Appl. No.: 412,202

[22] Filed: Sep. 25, 1989

[30] Foreign Application Priority Data

Sep. 23, 1988 [AU] Australia ..... PJ0589

[51] Int. Cl.[5] ..... C06C 7/00

[52] U.S. Cl. ..... 102/275.6; 102/275.5; 102/275.2

[58] Field of Search ..... 102/275.1, 275.2, 275.4, 102/275.5, 275.6, 275.7, 202.14

[56] References Cited

U.S. PATENT DOCUMENTS

| | | | |
|---|---|---|---|
| H, 215 | 2/1987 | Stewart | 102/487 |
| Re. 30,621 | 5/1981 | Calder, Jr. et al. | 102/275.7 |
| 1,832,924 | 11/1931 | Bleecker | 102/202.14 |
| 3,389,659 | 6/1968 | Cassidy et al. | 102/275.1 |
| 3,793,954 | 2/1974 | Johnston | 102/275.5 |
| 4,527,482 | 7/1985 | Hynes | 102/275.5 |
| 4,539.909 | 9/1985 | Day et al. | 102/275.2 |
| 4,637,312 | 1/1987 | Adams | 102/275.12 |
| 4,815,382 | 3/1989 | Yunan | 102/275.7 |

FOREIGN PATENT DOCUMENTS

| | | | |
|---|---|---|---|
| 0516869 | 1/1940 | United Kingdom . | |
| 0521014 | 5/1940 | United Kingdom . | |
| 0576219 | 3/1946 | United Kingdom . | |
| 0695601 | 8/1953 | United Kingdom . | |
| 0839412 | 6/1960 | United Kingdom . | |
| 1127279 | 9/1968 | United Kingdom . | |
| 1566071 | 4/1980 | United Kingdom . | |
| 2040413 | 8/1980 | United Kingdom . | |
| 2208913 | 4/1989 | United Kingdom . | |
| 668932 | 6/1979 | U.S.S.R. | 102/275.7 |

*Primary Examiner*—Deborah L. Kyle
*Assistant Examiner*—Stephen Johnson
*Attorney, Agent, or Firm*—Cushman, Darby & Cushman

[57] ABSTRACT

A primer is provided for use in detonating an explosive charge. The primer includes a rigid explosive-filled container which is fitted with an elongated neck. A bore in the neck extends into the explosive of the primer and provides accommodation for a firing device such as a detonator or fusecord. The primer is attached to a shock tube/wiring of a detonator or a fusecord with a fastener which is located at the end of the neck remote from the container and which is capable of supporting the entire weight of the primer. The container is preferably spherical and the neck is preferably formed from a plastics material which is molded with protrusions around which the fusecord/shock tube/wiring can be looped and with a griping device to hold them in place. The primers of the invention are particularly safe and efficacious in use.

8 Claims, 3 Drawing Sheets

PRIMER

This invention relates to primers for use with explosive charges.

It is common practice in blasting to detonate a charge of explosives by using a primer. A primer is basically a charge of high explosive which is adapted to receive an initiating means such as a detonating cord or a detonator. Thus, when the initiating means is fired, it initiates the high explosive of the primer which in turn initiates the main charge.

A primer is commonly cylindrical and is made in a cylindrical mould by simply pouring in molten explosive and allowing it to harden. Provision for the initiating means is made by having at least one cylindrical rod (most commonly two such rods) on the base of the mould which rod leaves an identically-shaped cylindrical hole in the primer.

Primers of the type described hereinabove have been used for many years. However, they are not without their difficulties, and different initiating means often give rise to different problems.

In the case where the initiating means is a detonator, difficulty arises as a result of the general configuration of the primer with detonator in place. Detonators are available in different lengths, largely because many detonators incorporate pyrotechnic delays which delay the time between the arrival of a firing signal at the detonator and the actual firing. As the delay is merely a pyrotechnic material of a particular length, the longer delay detonators are physically longer than those with no delay to such an extent that a long delay detonator will protrude quite a long way from a primer which will comfortably enclose a detonator with a short delay or no delay. This renders the long detonator very vulnerable to damage at the protruding end which is invariably that end to which the shock tube or wiring is joined. The usual solution is simply to provide a primer charge which is long enough to enclose the detonator completely, but this means keeping an inventory of at least two types of primer charge. It also means that there must be present in the larger primer rather more expensive high explosive than is necessary for efficient detonation of the main charge.

A further difficulty with primers to be detonated by detonators relates to the fact that that part of the detonator which actually detonates (the part where there is located a base charge of high explosive which is ignited by a firing signal to a fusehead received via, for example, electrical wiring or shock tubing) cannot readily be placed in the primer in that position where its detonation will have the greatest effect. As a general rule, the base charge, which is usually located at that end of the detonator which is remote from the end where enters the firing signal, should be positioned somewhere in the vicinity of the geometric centre of the primer charge. However, this is generally not possible or practicable and the base charge end is most frequently pushed into the primer until the detonator is completely concealed (for Protection as hereinabove mentioned), at which point the base charge end is generally close to the end of the primer. Thus, when the base charge ignites, the resulting explosion of the primer charge must be propagated back through nearly the entire bulk of the primer charge; this is clearly inefficient.

In the case where detonating cord is used, a primer charge with two cylindrical holes is generally used and the technique is to thread the cord through one of the holes, back through the second hole and then take it around the outside of the primer charge and through the loop defined by the cord exiting the first hole and entering the second. The weight of the primer charge bearing down on this end and tightening the loop as it does so thus holds the cord in place. This procedure can be awkward and inconvenient to carry out under typical conditions of use. Moreover, only friction secures the primer, and if handled roughly the cord may come loose.

The potential problems of rough handling are not confined to those instances where detonating cord is used. Where a detonator is used, the practice is again to use a primer charge with two holes, and the procedure is to thread the detonator and its attached wiring or shock tube through one hole and then insert the detonator completely into the second hole so that the primer charge can be suspended by the wiring or tube. This is also prone to accidental dislocation—rough handling may displace the detonator for the primer charge, giving rise to an inconvenient and often potentially hazardous situation.

It has now been found that these problems can be substantially or completely overcome by the use of a novel primer. There is therefore provided, according to the present invention, a primer for the detonation of explosives, the primer being fired by firing means which receives a firing signal from a command source via continuous elongate flexible transmission means directly connected to the firing means, the primer comprising a charge of explosive to which charge is appended an elongate neck, there being within the neck and the charge a continuous bore whose axis is essentially parallel to the longitudinal axis of the neck and is so dimensioned as to accommodate a given firing means to any extent necessary to ensure its protection or its efficient functioning or both, the neck comprising, at that end thereof remote from the primer charge, fastening means capable of fastening to the transmission means such that the weight of the primer may be supported thereby.

The primers according to this invention are detonated by firing means which receive a firing signal from a command source via continuous elongate flexible transmission means directly connected to the firing means. The command source may be any known conventional command source such as an exploder to which the firing means is directly connected. It may also be a n"wireless" type, the signal being transmitted by, for example, radio emissions which are received by a receiving station and the firing signal communicated onwards by means of continuous elongate flexible transmission means joining receiving station and firing means. The firing means may be any means known to the art which is capable of detonating a primer. It can be, for example, a detonator or a detonating cord. The continuous elongate flexible transmission means may similarly be any means suitable for communicating a firing signal to the firing means. It may be, for example, a detonating cord, so that a single length of detonating cord constitutes both firing means and transmission means. If the firing means is a detonator, several transmission means are possible. The transmission means may be a shock tube or electrical wiring, the type of detonator being selected to suit the particular transmission means. In the case of an electrically-fired detonator, considerable versatility is possible. For example, the detonator may be an electronic type which is capable of more precise firing than one with a normal pyrotechnic delay. Such detonators may also have other features such as programmability (so that the delay can be changed at any time before blasting) and security (so that accidental or illegal firing is virtually impossible). The electrical signal for such detonators may be a single electrical pulse or it may comprise one or more analogue or digital signals.

The primer comprises a charge of explosive (the "primer charge") which may be selected from the commonly available explosives known to be suitable for such a task. These include pentaerythritol tetranitrate (PETN) and cyclotrimethylene trinitramine (RDX). There is attached to this charge an elongate neck. This may be attached directly to the charge by, for example, clamping means or by casting the explosive around a suitable neck, but it is preferred that the explosive be housed within a rigid container. The neck may be made integrally with the container, but it is preferred that it be a separate component able to be fitted to a container. Thus, it is possible to use different sizes of necks; this is an especially useful embodiment when detonators are to be used as firing means, as the size of neck can be altered in order to accommodate different lengths of detonators. It is also possible (and preferable) in this case to make the neck easily detachable from the container such that a detonator may be easily removed should this prove necessary.

The container may be any convenient shape, but the preferred shapes are in order of preference, a sphere and a cylinder. The advantages of the sphere will be further discussed hereinunder.

Within the neck and the charge there is a continuous bore whose axis is essentially parallel to the longitudinal axis of the neck, that is, it runs through the neck and into the primer charge. The bore may penetrate completely through the charge and, when present, the container, or it may stop within the charge and/or the container; the extent to which the bore penetrates the charge depends entirely on the necessary extent to which a given firing means must be accommodated, and this will be further discussed hereinunder. The diameter of the bore within the charge should be such that the firing means to be used may be readily but firmly fitted therein; in this regard it is thus no different from the standard practice of the art with known primers In many embodiments, the bore is coaxial with the neck, but in other embodiments the nature of the construction make it necessary that the bore not be coaxial with the neck. The question as to whether a coaxial bore is needed may be easily decided by the skilled person.

That part of the bore within the neck may be provided by simply moulding the neck in an appropriate shape. That part of the bore within the primer charge may be put there by simply boring an appropriate hole in the solid explosive of the primer charge. Alternatively, a rod having the dimensions of the required bore may be inserted, molten explosive poured around it and the rod removed when the explosive has solidified. In a preferred embodiment, a hollow insert whose internal dimensions are those of the desired bore is fitted into the container. This insert remains in place after the addition and solidification of molten explosive.

The bore is so dimensioned as to accommodate the firing means to any extent necessary to ensure that the firing means is safely incorporated into the primer or is subsequently able to detonate the primer charge (that is, with a good utilisation of the potential explosive energy in a given primer charge), or both of those objectives. The extent necessary for a given firing means and the method of achieving it are very much dependent on the nature of the firing means itself. For example, it is well known to the art that when a detonation cord is cut, the last few centimeters of the cut end which is at the primer charge does not function as well as the of the cord. The practice of the art is to allow for this. In this invention, when such a situation arises, the bore generally extends completely through the primer and the cut end of the detonating cord is either allowed to dangle from the lower end of the bore, or is tied off in some way. In the case of a detonator being used as firing means, it is necessary to protect the detonator from accidental damage, especially that part of the detonator to which the transmission means is attached. It is also preferable that the base charge of the detonator be so located, with respect to the primer charge, that the most efficient results will be obtained.

As mentioned hereinabove, one of the drawbacks of conventional primer technology is that the base charge of the detonator is usually placed at one end of the primer charge. The best position would be at or near the geometric centre of the charge, but this has not previously been possible as a large long-delay detonator placed in such a position would protrude substantially from the primer, making it very vulnerable to accidental damage and potentially extremely hazardous to operators. In the primer of this invention, the detonator may be positioned in any desired position relative to the primer charge and it remains protected by the neck.

The positioning of a detonator in relation to the primer charge may be achieved by any convenient means. It may be done, for example, by creating in the primer charge a bore which is so dimensioned that the base charge portion of the detonator will rest on the bottom of the bore in the correct position. Alternatively, where a deeper bore has been used, spacing elements of the correct size may be inserted. A third alternative is to fasten the transmission means at that end of the neck remote from the primer charge such that the detonator remains in the correct juxtaposition therewith, the primer weight being borne by the fastening of the primer to the transmission means.

The fastening of the primer to the transmission means such that the entire weight of the primer may be supported thereby is an important feature of the present invention. As previously described, the known art has relied on methods of securing primers to transmission means which have been awkward to execute and often potentially hazardous. The fastening aspect of the present invention substantially overcomes all of these problems.

The fastening means is located at that end of the neck remote from the primer charge. Any fastening means which is capable of gripping the transmission means such that it can support the weight of the primer is suitable for use in the invention. Naturally, the fastening means must also allow the transmission means to perform its function; for example, it must not completely close a shock tube. The skilled person will appreciate that there are a number of possibilities. For example, there are various types of snap fittings which, once interlocked, can be parted only with difficulty. An especially preferred fastening means is described in copending Australian application PJ 0590.

This fastening means comprises attaching means adapted to permit the attachment of the fastening means to the primer, and gripping means adapted to grip the transmission means, the gripping means comprising:

(a) a pair of opposed jaws at least one of which jaws is movable towards the other, which jaws comprise gripping surfaces which are so shaped as to deform the transmission means in the plane of closing motion of the jaws such that the transmission means may be gripped to the desired extent; and (ii) securing means for holding the jaws in fastening contact with the transmission means.

The gripping surfaces can be any desired shape, and a considerable number will be obvious to the person skilled in the art. They may, for example, be sawtoothed or sinusoidal in profile and substantially exactly matching. Alternatively, they may be essentially planar but with this planarity disrupted by one or more protrusions in at least one jaw. These protrusions may have matching depressions in the opposing jaw, or each jaw may have a set of protrusions and a transmission means will be held in a sinusoidal manner between them.

The securing means may be any suitable securing means which holds the jaws in contact with the transmission means. A particularly effective means is a ratchet means. In this case, each jaw comprises a planar protruding member which bears a series of ridges and splines. These ridges or splines interact with a matching set of ridges or splines on the other jaw and when the jaws are urged towards each other against the resilience of the transmission means, the sets of ridges and splines interlock to grip the transmission means tightly.

A further especially preferred fastening means is so shaped externally as to define a pathway which the transmission means is constrained to follow such that, in following the pathway from a transmission means from which the primer is suspended to the suspended primer, the transmission loops in a substantially vertical plane through 360°, the pathway being additionally equipped with at least one gripping member at least one of which is positioned at a part of the loop wherein, when an object is suspended, a tangent thereto would be substantially horizontal. This fastening means is described in Australian Patent Application No. PJ 5177. Preferred embodiments of this particular fastening means have no moving parts and are especially reliable and robust and easy to use.

A typical preferred embodiment of this type essentially comprises a cylinder in which surface is formed a series of grooves which define the pathway. These constrain a transmission means to form a loop and gripping members grip the loop at at least one (and preferably both) of the points wherein a tangent thereto would be substantially horizontal. The weight of the suspended primer tends to pull the looped transmission means more tightly into the gripping members, thereby offering a more secure grip.

The materials used by the present invention are common and do not involve much outlay. The detonators and primer charge explosives are those commonly used by the art. The neck and, where used, the rigid container and the insert can be made of plastics materials such as polyethylene and polypropylene and are easily moulded by conventional techniques. The design parameters of the container, neck and insert are readily attainablele by the skilled person. For example, where an insert is used, it clearly must have the appropriate physical characteristics such that it retains its shape when molten explosive is poured into the container, yet it must have walls thin enough so as to allow the firing means effectively to fire the primer. Such details can readily be provided by the skilled person.

One of the features of the present invention is that the primer may be made spherical. This is an unusually efficient shape for a primer in that the propagation of the explosion of the base charge is almost entirely uniform throughout. It has previously been possible to make spherical primers which are to be fired by detonating cord, but this type has suffered from the same drawbacks as have known cylindrical primers. On the other hand, the making of a spherical primer which is to be fired by a detonator has been practically impossible. This invention makes the advantageous spherical shape practicable, even for detonator-fired primers—the detonator base charge may be located at the geometric centre of the sphere and the protruding part of the detonator is adequately protected.

The invention will now be further illustrated with reference to the drawings which depict a preferred embodiment.

Figure 1:
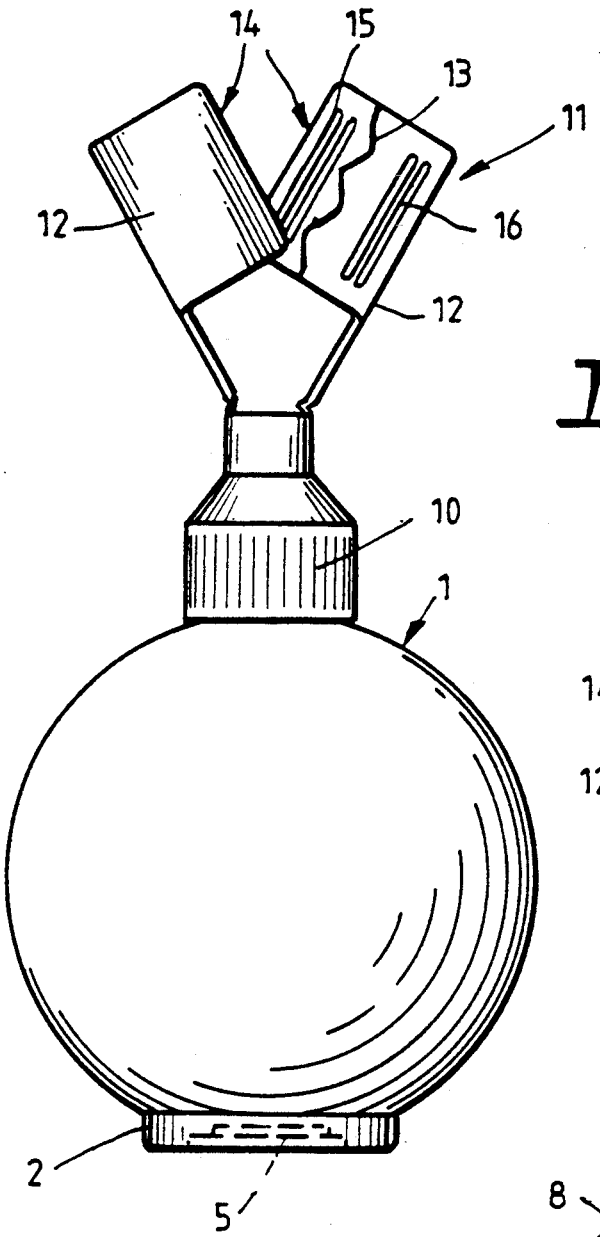
FIG. 1 is an elevational view of a container for a primer according to the invention, with neck and fastening means.
Figure 2:
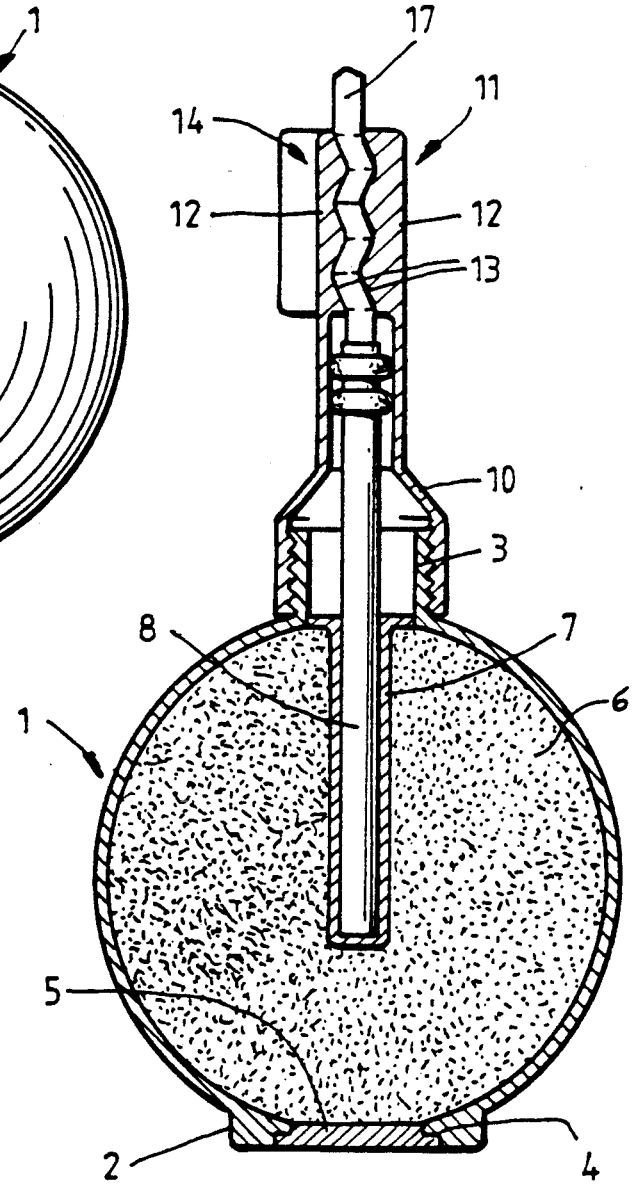
FIG. 2 is an elevational section of a primer according to the invention with a detonator and shock tube (neither shown sectioned) in place.
Figure 3:
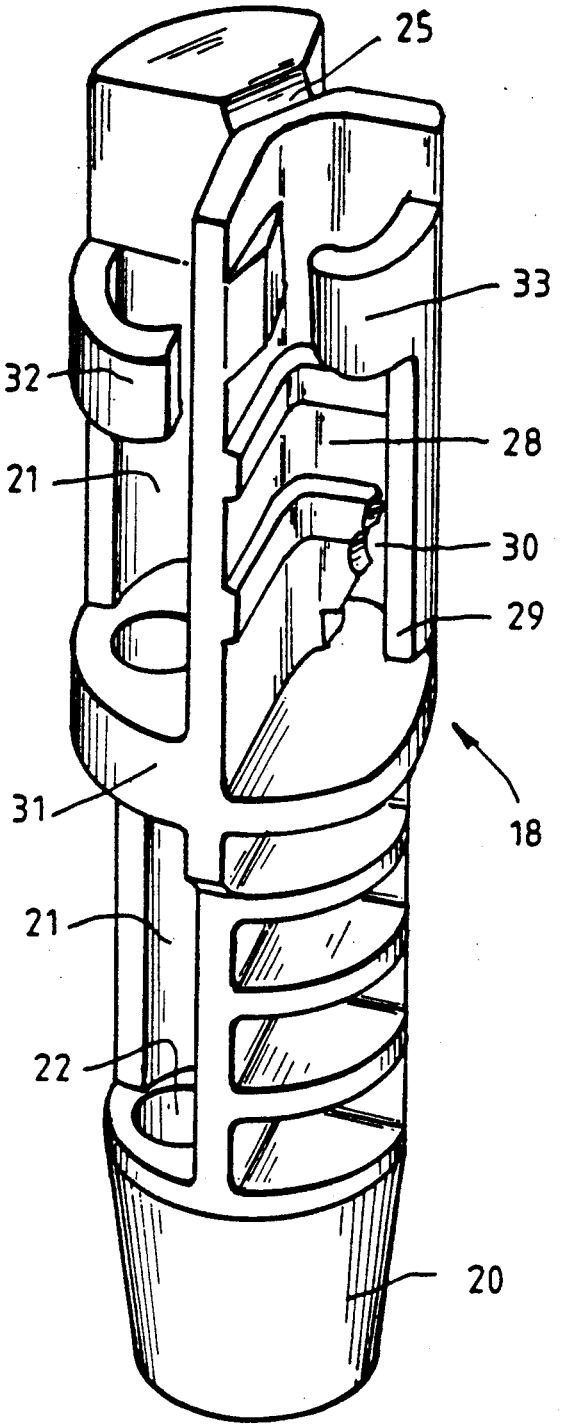
FIG. 3 is a perspective view of a particular embodiment of a neck.
Figure 4:
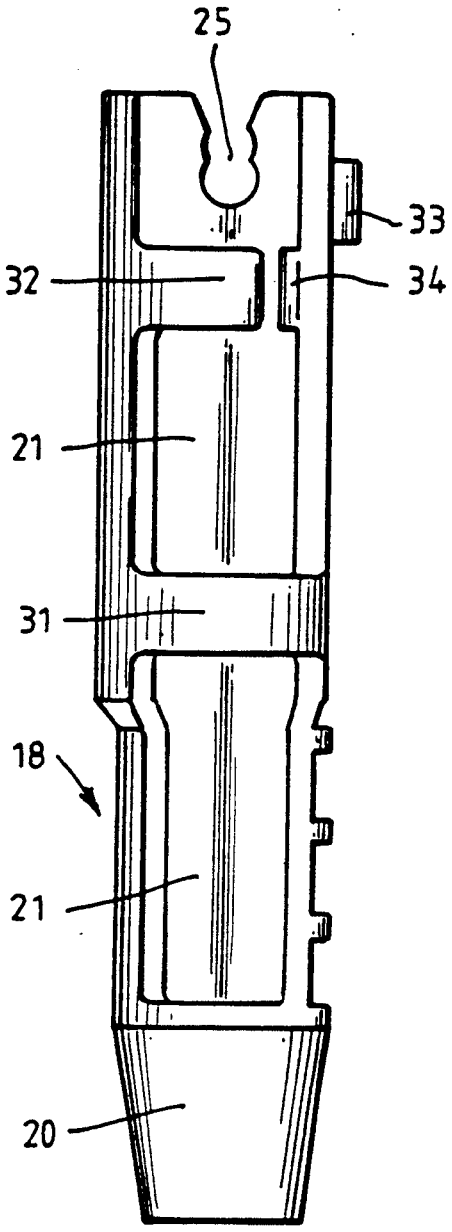
FIG. 4 is an elevational view of the embodiment of FIG. 3.
Figure 5:
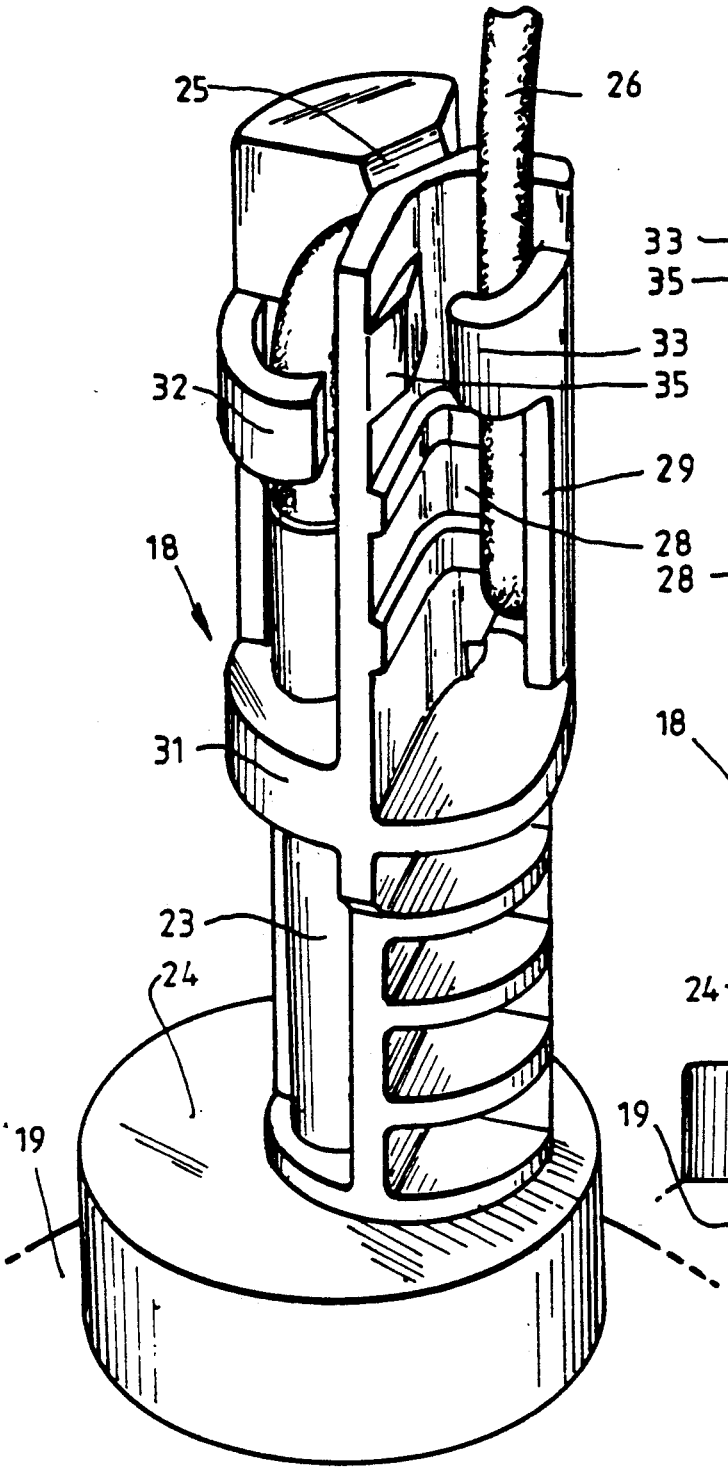
FIG. 5 is a partial perspective view of the embodiment of FIG. 3 with a detonator and shock tube in place and fitted in a primer according to the invention.
Figure 6:
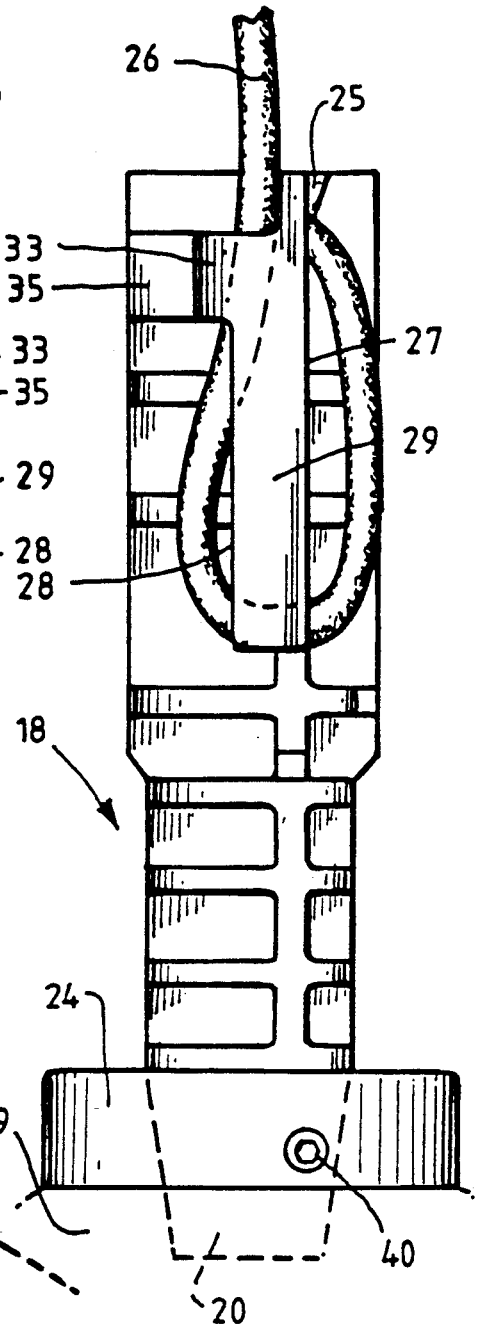
FIG. 6 is a partial elevational view of the embodiment of FIG. 5 viewed from a perspective 180° away from that of FIG. 5.

Considering, first of all, the embodiments of FIGS. 1 and 2, a container for a primer according to the invention is a spherical blow-moulded vessel 1 which has an integral stabilising base 2 allowing it to stand upright, and a threaded neck 3. At the base is a port 4 through which molten explosive can be poured, and the port then plugged with stopper 5. The solidified explosive comprises a primer charge 6. Into the threaded neck 3 of the vessel 1 is fitted a cylindrical insert 7, the interior dimensions of this insert being close to those of a detonator 8 which is housed therein. To the threaded neck 3 of the vessel is screwed a top 10 which generally tapers away from the vessel 1. At the end of the top 10 remote from the vessel is a clamping device 11 which is integral with the top. The clamping device comprises two opposed planar arms 12 which at their points of attachment to the top 10 are grooved to confer on the pieces the ability to bend towards each other but not to bend substantially in a plane lateral to that plane of bending. At that end of each arm 12 removed from the point of attachment is a series of sawtooth projections 13 which project towards a mating series of projections in the other arm and whose lateral width is at least equal to the diameter of a shock tube 17 attached to a detonator 8 which will be inserted into the primer charge.

On one side of each series of sawtooth projections is a planar ratchet member 14 which projects towards the opposing arm 12 at right angles to the plane of the arm to which it is attached. The ratchet member bears on its surface a series of ridges 15 which are parallel to the arm 12 of which the ratchet member forms part. These ridges are designed to interlock with a cooperating series of ridges 16 which are located on the side of the series of sawtooth projections on the other arm 12. Thus, when the two arms 12 are pushed towards each other, the respective series of ridges interlock and prevent the two arms from moving apart.

In practice, a vessel 1 is fitted with an insert 7, inverted, filled with molten explosive via the port 4 and then plugged with the stopper 5. To the threaded neck is screwed the top 10. The detonator 8 with affixed shock tube 17 is placed into the insert. Dimensions are such that the base charge of the detonator will be at or near the geometric centre of the primer charge 6 and that end of the detonator to which the shock tube is attached will lie completely within the top, thus being completely protected. When the detonator is fully home, the two arms 12 are pushed together. The opposing series of sawtooth projections 13 deform the shock tube 17 such that it conforms with their shapes and the series of ridges 15 on the ratchet members 14 interlock with the cooperating series of ridges 16 on the opposing sawtooth projections thus locking the two arms together. The grip of the clamping device 11 is such that the weight of the primer may be supported thereby.

Considering now the embodiment depicted in FIGS. 3–6, a neck 18 is a single entity moulded from a resilient plastics material which has essentially the form of a cylinder which, towards one end thereof, tapers to form a plug 20 which is adapted to be inserted into a circular orifice in a primer 19. The neck is provided with a deep longitudinal, essentially V-shaped groove 21 which terminates at the plug end in a cylindrical bore 22 through which a detonator 23 can be inserted into the primer. The orifice in the primer is offset in a cylindrical boss 24 of the primer such that the detonator is positioned in the primer such that the detonator base charge is located at or near the geometric centre of the primer 19. At its upper end, groove 21 communicates with a groove 25 which is transverse to the longitudinal axis of cylinder. The walls of this groove 25 are so shaped as to create gripping means suitably dimensioned to grip shock tube 26 attached to the detonator. At the end of the groove 25 which is remote from the groove 21 is a shallow longitudinal groove 27 which forms a pathway along which the shock tube 26 runs. This groove extends part-way down the fastening means, it being separated from a further longitudinal groove 28 by an elongate projection 29, the groove 28 being disposed between the shallow groove 27 and the groove 21. At the lower end of the projection is a notch 30, this being so profiled and dimensioned as to provide a gripping element for the shock tube 26. The shock tube 26 thus exits from the groove 21 via the groove 25, travels down the groove 27 and enters the groove 28 via the notch 30. The shock tube then continues along the groove 28 towards the upper end of the fastening means and leaves the fastening means.

In practice, the fastening means 18 hereinabove described is readily fixed to the primer 19 by means of an Allen screw 40 in the boss 24. The detonator 23 is then inserted into the primer and the shock tube 26 forced through the groove 25 and the notch 30. In order to better protect the detonator and provide better location of the shock tube, the fastening means is provided with an integral curved bridge 31 (essentially a continuation of the surface of the cylinder) which spans the groove 21 and which overlies the sensitive crimp where the shock tube joins the detonator. Two further projections, 32 near the top of the groove 21 and 33 near the top of the groove 28, act to locate the shock tube. These co-operate with ridges (34 and 35 respectively) located on the opposing walls of the respective grooves, the gap between the respective projection-ridge pairs being smaller than the diameter of the shock tube. Thus, when the tube is being fitted in place, it is "snapped through these gaps and is firmly located.

In use, the primer equipped with its detonator and shock tube (or detonator and electrical wiring or ignition cord as the case may be) is lowered into a bore hole, and explosive is then added to the bore hole. The weight of the primer pulls and shock tube wiring or ignition cord more tightly into the groove 25 and the notch 30, making the fastening very secure, and the detonator is adequately protected from mechanical damage.

We claim:

1. A primer for detonating explosives, the primer being fired by firing means which receives a firing signal via continuous elongate flexible transmission means directly connected to the firing means, the primer comprising a charge of explosive to which charge is appended an elongate neck, there being within the neck and the charge a continuous bore having an axis substantially parallel to a longitudinal axis of the neck and dimensioned so as to accommodate said firing means to an extent which ensures at least one of protection of said firing means and an efficient functioning of said firing means, the neck comprising, at an end thereof remote from the primer charge, fastening means for fastening the primer to the transmission means such that the primer can be fully supported by said transmission means and wherein there is within the primer explosive charge a hollow insert having a bore of a diameter which permits a firm fitting of the firing means.

2. A primer according to claim 1, wherein the continuous bore is substantially coaxial with the neck.

3. A primer according to claim 1, wherein the charge of explosive is housed within a rigid container to which the neck is attached.

4. A primer according to any one of claims 1—3, wherein the primer is one of cylindrical, and spherical.

5. A primer according to claim 4, wherein the primer is spherical.

6. A primer according to claim 1, wherein the firing means is a detonator and the hollow insert is so dimensioned that a base charge of the detonator is located substantially adjacent a geometric centre of the primer explosive charge.

7. A primer for detonating explosives, the primer being fixed by firing means which receives a firing signal via continuous elongate flexible transmission means directly connected to the firing means, the primer comprising a charge of explosive to which charge is appended an elongate neck, there being within the neck and the charge a continuous bore having an axis substantially parallel to a longitudinal axis of the neck and dimensioned so as to accommodate said firing means to an extent which ensures at least one of protection of said firing means and an efficient functioning of said firing means, the neck comprising, at an end thereof remote from the primer charge, fastening means for fastening the primer to the transmission means such that the primer can be fully supported by said transmission means and wherein the fastening means comprises gripping means for gripping the transmission means and attaching means for attaching the gripping means to a remainder of the neck, the gripping means comprising:

(i) a pair of opposed jaws at least one of which jaws is movable towards the other, which jaws comprise gripping surfaces which are so shaped as to deform the transmission means in a plane of closing motion of the jaws such that the transmission means may be gripped to a desired extent; and (ii) securing means for holding the jaws in fastening contact with the transmission means.

8. A primer for detonating explosives, the primer being fired by firing means which receives a firing signal via continuous elongate flexible transmission means directly connected to the firing means, the primer comprising a charge of explosive to which charge is appended an elongate neck, there being within the neck and the charge a continuous bore having an axis substantially parallel to a longitudinal axis of the neck and dimensioned so as to accommodate said firing means to an extent which ensures at least one of protection of said firing means and an efficient functioning of said firing means, the neck comprising, at an end thereof remote from the primer charge, fastening means for fastening the primer to the transmission means such that the primer can be fully supported by said transmission means, and wherein the fastening means is so shaped externally as to define a pathway which the transmission means is constrained to follow such that, in following the pathway of said transmission means from which the primer is suspended, a transmission means loop in a substantially vertical plans, the pathway being additionally equipped with at least one gripping member at least one of which is positioned at a part of the loop wherein, when the primer is suspended from that part of the loop of the transmission means, a tangent drawn to that part of the loop is substantially horizontal.

* * * * *